US008770277B2

(12) United States Patent
Artherholt

(10) Patent No.: US 8,770,277 B2
(45) Date of Patent: Jul. 8, 2014

(54) FRAC HEAD WITH SACRIFICIAL WASH RING

(75) Inventor: Danny Lee Artherholt, Asher, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 322 days.

(21) Appl. No.: 13/240,166

(22) Filed: Sep. 22, 2011

(65) Prior Publication Data

US 2013/0075079 A1 Mar. 28, 2013

(51) Int. Cl.
*E21B 43/26* (2006.01)
*E21B 33/03* (2006.01)

(52) U.S. Cl.
USPC ..... 166/177.5; 166/75.15; 166/90.1; 166/376

(58) Field of Classification Search
USPC ..... 166/90.1, 75.5, 177.5, 376, 75.15
See application file for complete search history.

(56) References Cited

U.S. PATENT DOCUMENTS 1,601,093 A * 9/1926 Widmeyer ..... 285/16
4,546,828 A * 10/1985 Roche ..... 166/84.4
4,811,799 A * 3/1989 Blackwell et al. ..... 175/209
5,012,865 A * 5/1991 McLeod ..... 166/90.1
6,899,172 B2 * 5/2005 McLeod et al. ..... 166/90.1
7,125,055 B2 * 10/2006 Dallas ..... 285/354
7,213,641 B2 5/2007 McGuire et al.
7,478,673 B2 * 1/2009 Boyd ..... 166/90.1
7,484,776 B2 * 2/2009 Dallas et al. ..... 285/354
7,628,201 B2 12/2009 McGuire et al.
7,789,133 B2 9/2010 McGuire
7,828,053 B2 11/2010 McGuire et al.
8,016,031 B2 9/2011 McGuire
2002/0011336 A1 * 1/2002 Baskett et al. ..... 166/368
2007/0251578 A1 11/2007 McGuire
2008/0083530 A1 * 4/2008 Boyd ..... 166/90.1
2009/0236090 A1 * 9/2009 McGuire ..... 166/90.1
2010/0326648 A1 * 12/2010 McGuire ..... 166/90.1
2011/0048698 A1 3/2011 McGuire et al.
2011/0168384 A1 7/2011 McGuire et al.
2013/0075079 A1 * 3/2013 Artherholt ..... 166/177.5

* cited by examiner

*Primary Examiner* — Jennifer H Gay

(74) *Attorney, Agent, or Firm* — Nelson Mullins Riley & Scarborough, LLP

(57) ABSTRACT

A frac head is provided with a sacrificial wash ring. The sacrificial wash ring is located above a mixing chamber of the frac head. The sacrificial wash ring protects the frac head body from erosion caused by abrasive frac fluids pumped through the frac head.

20 Claims, 3 Drawing Sheets

FRAC HEAD WITH SACRIFICIAL WASH RING

FIELD OF THE INVENTION

This invention relates in general to hydrocarbon well stimulation equipment and, in particular, to a frac head with a wash control ring.

BACKGROUND OF THE INVENTION

Current methods for completing or re-completing hydrocarbon wells generally involve pumping very large volumes of fracturing fluids into one or more production zones of the well. Currently used fracturing fluids are often mixtures of large volumes of abrasive propant (e.g., frac sand, sintered bauxite, or ceramic pellets) mixed with a "slick water" (water containing a chemical surfactant). Those fracturing fluids may be pumped through the frac head and down a production casing into production zone(s) of the hydrocarbon well at fluid pressures of 15,000+ psi and flow rates of 180+ barrels/minute. As understood by those skilled in the art, pumping the fracturing fluids at high pressures and flow rates requires many frac pumps. Each frac pump is connected to a fluid line known as a "frac iron". Several frac pumps may be connected in parallel to a single frac iron. Each frac iron is connected to a port of the frac head and injects a high pressure stream through that port. The converging fluid streams cause flow turbulence where the respective fluid streams converge in a mixing chamber of the frac head. The flow turbulence propels the abrasive propant against the inner surfaces of the frac head, which tends to erode those surfaces of the frac head. This erosion is commonly referred to as "wash".

Although significant advances have been made in the design of frac heads to resist and/or control frac head erosion, further improvements that extend a service life of the frac head remain desirable.

There therefore exists a need for a frac head with a sacrificial wash ring that extends frac head service life.

SUMMARY OF THE INVENTION

It is therefore an object of the invention to provide a frac head with a sacrificial wash ring that is easier to maintain and is yet more resistant to erosion than known prior art frac heads.

The invention therefore provides a frac head, comprising: a frac head body having a top end with an axial port and an axial passage that extends though the axial port and the frac head body; at least two inlet ports that respectively provide a fluid communication path to the axial passage where fluid streams pumped through the respective inlet ports converge; and a sacrificial wash ring in the axial passage adjacent a bottom edge of the respective fluid communication paths, the sacrificial wash ring directing fluid streams pumped through the respective inlet ports into a mixing chamber located below the sacrificial wash ring.

The invention further provides a frac head, comprising: a frac head body having a top end with an axial port and a axial passage that extends though the axial port and the frac head body; at least two inlet ports that respectively provide a fluid communication path to the axial passage; and a sacrificial wash ring in the axial passage at a bottom edge of the respective inlet ports, the sacrificial wash ring having a top surface that is inclined at an angle that is similar to an angle of inclination of the respective inlet ports so that frac fluid flows past a bottom edge of each fluid communication path; a cylindrical central surface that forces respective frac fluid streams to converge as they enter a mixing chamber below the sacrificial wash ring; and, a bottom surface that is downwardly and outwardly inclined to permit the converging frac fluid streams to rapidly expand as they enter the mixing chamber.

The invention yet further provides a frac head, comprising: a frac head body having a top end with an axial port and a axial passage that extends though the axial port and the frac head body; at least two inlet ports that respectively provide a fluid communication path to the axial passage; and a sacrificial wash ring in the axial passage at a bottom edge of the respective inlet ports, the sacrificial wash ring having a top surface and a bottom surface, the top surface being inclined at an angle of about 60° with respect to an angle of inclination of the respective inlet ports, and the bottom surface being inclined at an angle of about 15° with respect to the top surface.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a frac head with a sacrificial wash ring that extends a service life of the frac head. The sacrificial wash ring channels abrasive fluids into a mixing chamber of the frac head in a way that reduces erosion of the frac head body, so a service life of the frac head body is prolonged. The sacrificial wash ring erodes over time, but it is easily and inexpensively replaced without welding or other time consuming maintenance operations.

Figure 1:
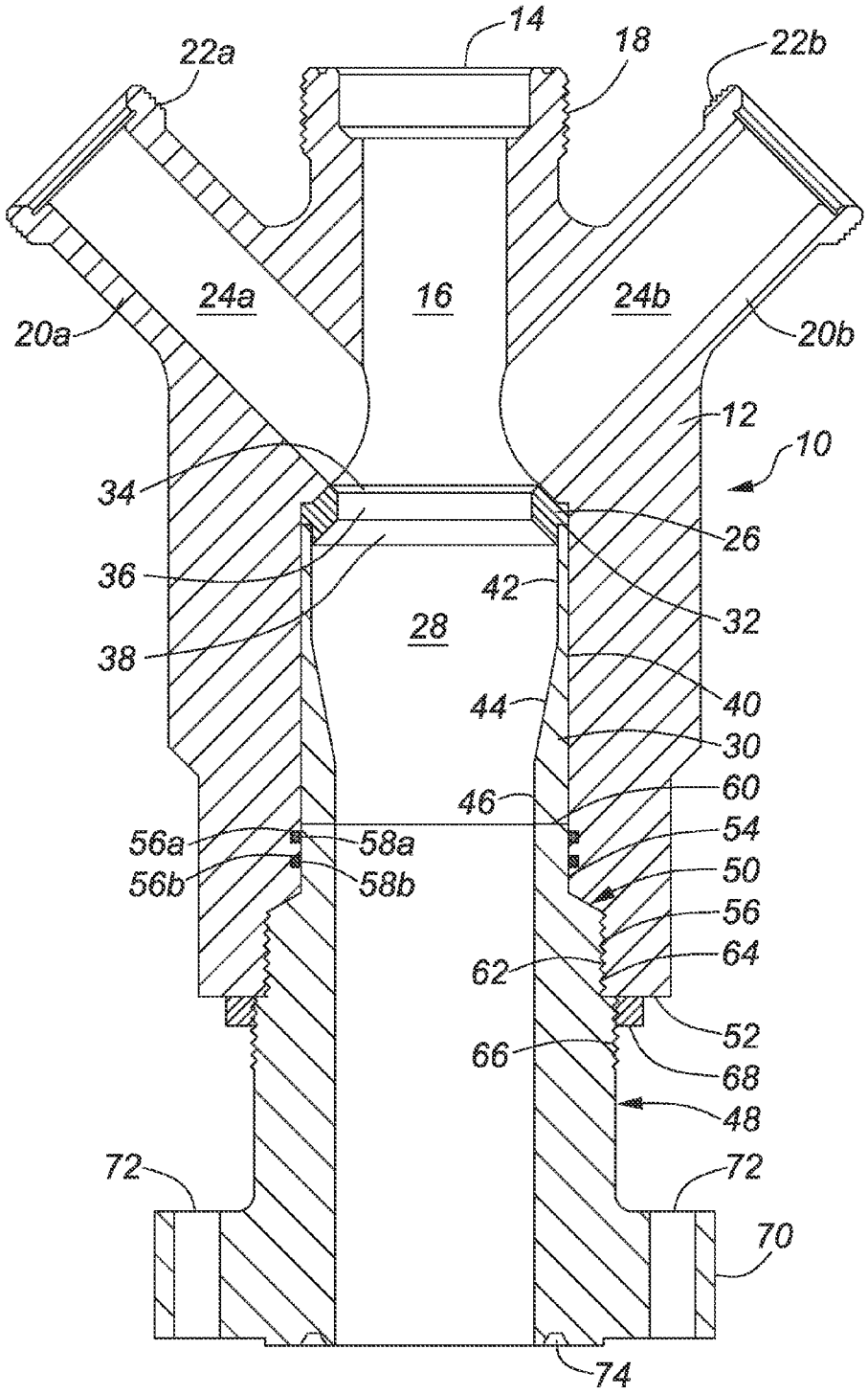
FIG. 1 is a schematic cross-sectional diagram of one embodiment of a frac head with a sacrificial wash ring in accordance with the invention.

FIG. 1 is a schematic cross-sectional view of one embodiment of a frac 10 head in accordance with the invention. The frac head 10 includes a frac head body 12 with an axial port 14 at the top of an axial passage 16 that extends through the frac head body 12. The axial port 12 terminates in a threaded union 18 described in Assignee's U.S. Pat. No. 7,125,055.

At least two inlet ports 20*a*, 20*b* have outer ends provided with proprietary unions 22*a*, 22*b* that accommodate the connection of "frac irons" in a manner well known in the art. A frac head will typically have at least 4 inlet ports. Each inlet port 20*a*, 20*b* provides a fluid communication path 24*a*, 24*b* to the axial passage 16, where fluid streams pumped through the inlet ports 20*a*, 20*b* converge. At a bottom edge of each fluid communication path 24*a*, 24*b* is a sacrificial wash ring 26 in accordance with the invention. Below the sacrificial wash ring is a mixing chamber 28 that is lined with a wear resistant liner 30. A top end 32 of the wear resistant liner 30 supports the sacrificial wash ring 26.

The sacrificial wash ring 26 has a downwardly inclined top surface 34 that is inclined at an angle that is similar to an inclination of the respective inlet ports 20*a*, 20*b*, so that frac fluid flows without deviation past a bottom edge of each fluid communication path 24*a*, 24*b*. The sacrificial wash ring 26 also has a cylindrical central surface 36 that forces the respective frac fluid streams to converge as they enter the mixing chamber 28. The sacrificial wash ring 26 further has a bottom surface 38 that is downwardly and outwardly inclined to permit the converging frac fluid streams to rapidly expand as they enter the mixing chamber 28. In this embodiment, the bottom surface of the sacrificial wash ring 26 is downwardly and outwardly inclined at an angle of about 45° with respect to a central axis of the frac head body 12. It should be understood that an angle of inclination of less than or considerably greater than 45° could be used for the bottom surface 38 of the sacrificial wash ring 26. The shape of the sacrificial wash ring 26 reduces turbulence as the converging frac fluid streams flow into the mixing chamber 28, as will be explained below in more detail with reference to FIG. 2. In one embodiment, the sacrificial wash ring is machined from AISI 4340 steel that is heat treated to a Rockwell hardness of 28-50 RC.

The wear resistant liner 30 in the mixing chamber 28 has a cylindrical outer sidewall 40 and an inner sidewall that has a cylindrical upper section 42, a downwardly and inwardly inclined central section 44 and a cylindrical lower section 46. In this embodiment the wear resistant liner 30 is made of hardened 4140 steel, though any durable wear resistant material including a ceramic material may be used to line the mixing chamber 28.

The wear resistant liner 30 is supported by a bottom leg 48 threadedly secured in a bottom leg socket 50 machined into a bottom end 52 of the frac head body 12. The bottom leg socket 50 includes a seal bore 54 located inwardly of a box thread 56. The seal bore 54 includes two O-ring grooves 56*a*, 56*b* that respectively accept O-rings 58*a*, 58*b*. A top end 60 of the bottom leg 48 is received in the seal bore 54 and cooperates with the O-rings 58*a*, 58*b* to provide a high-pressure fluid seal between the bottom leg 48 and the bottom leg socket 50. A first pin thread 62 on the bottom leg 48 engages the box thread 56 to secure the bottom leg 48 in the bottom leg socket 50. A second pin thread 66 on the bottom leg 48 supports a lock nut 68 that is tightened against the bottom end 52 of the frac head body 12 to inhibit rotation of the bottom leg 48 with respect to the frac head body 12. The bottom leg 48 terminates in a flange 70 having a plurality of through bores 72 that accept flange bolts for connecting the frac head to another flanged flow stack component, such as a high-pressure valve, a blowout preventer, a wellhead, or the like. The flange 70 also has a metal ring gasket groove 74 that accepts a metal ring gasket in a manner known in the art. In one embodiment the flange is a standard American Petroleum Institute (API) flange, and the metal ring gasket groove accepts one of an API R, RX or BX metal ring gasket.

Figure 2:
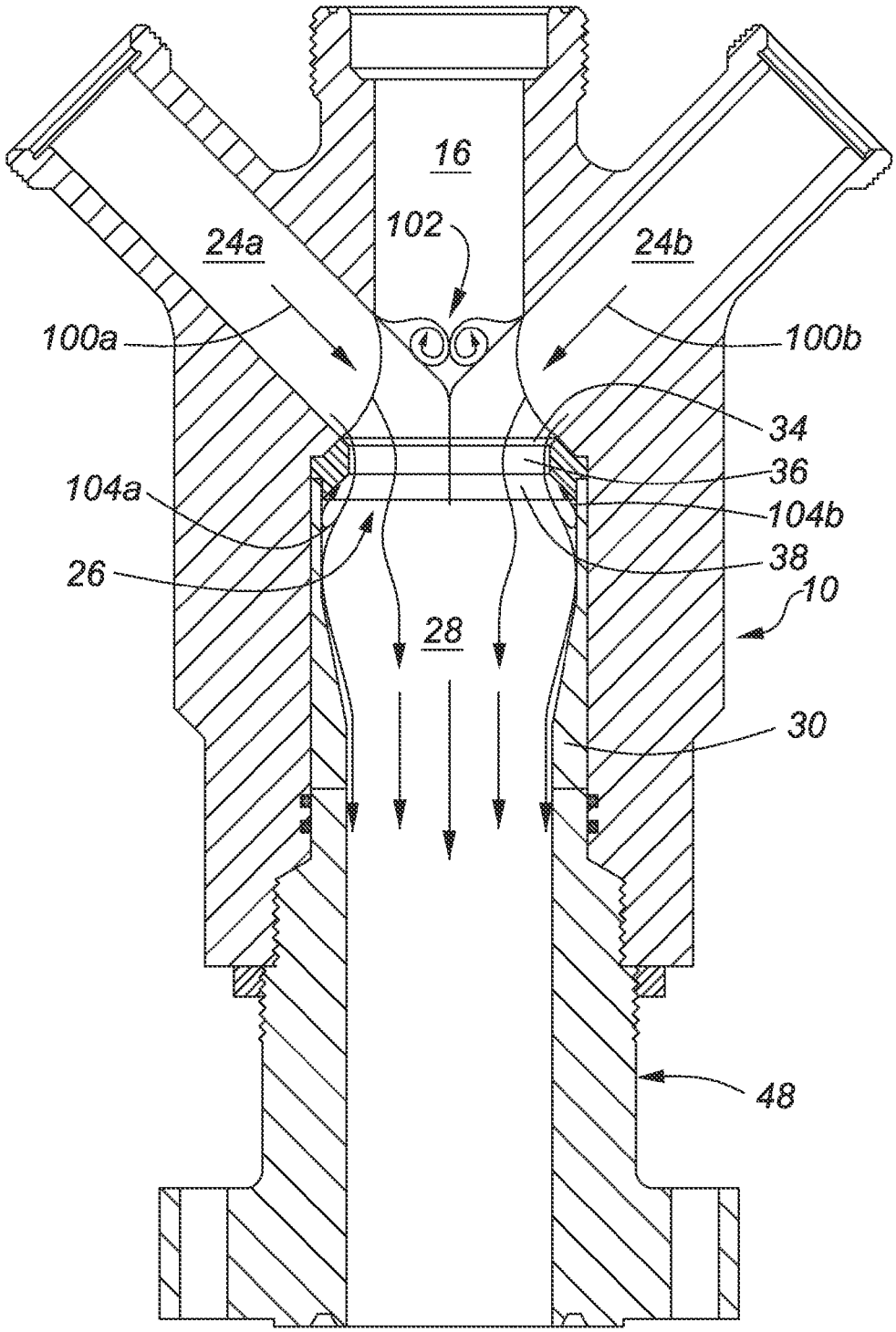
FIG. 2 is a schematic diagram of frac fluid flow through the frac head shown in FIG. 1.

FIG. 2 is a schematic diagram of frac fluid flow through the frac head 10. It should be understood that fluid flow through the frac head 10 is complex and dynamic and dependent on many factors, including flow stream balance. It should be further understood that fluid flow through the frac head cannot be observed directly, but only inferred by observation of erosion patterns when the frac head is inspected after a well stimulation procedure.

Assuming two balanced flow streams, as frac fluid is pumped through the respective fluid communication paths 24*a*, 24*b*, a main proportion 100*a*, 100*b* of the respective fluid streams flow into the axial passage 16 and down through the mixing chamber 28 with little turbulence. However, friction along the periphery of the respective fluid communication paths 24*a* and 24*b* slows down peripheral flow and the convergence of the fluid streams causes turbulence 102 in the axial passage 16 above the point of convergence. The turbulence 102 is substantially centralized and causes essentially no wash in the axial passage 16. At the bottom edge of the fluid streams, fluid friction causes a slow erosion of the top surface 34 and cylindrical central surface 36 of the sacrificial wash ring 26. As well, while turbulence is reduced by the rapid expansion of the respective fluid flows in the mixing chamber 28 due to the downwardly and outwardly inclined bottom surface 38 of the sacrificial wash ring 26, reverse upward flows 104*a* 104*b* are established under the sacrificial wash ring 26. Since these flows are confined by the respective fluid streams they behave more aggressively than the turbulence 102. As a result, the sacrificial wash ring 26 is slowly eroded upwardly from the bottom surface 38, while erosion of the wear resistant liner 30 is controlled. Periodic inspection of the sacrificial wash ring 26 and the wear resistant liner 30 and replacement of either one as necessary ensures that the integrity of the valuable frac head body 12 is maintained. The sacrificial wash ring 26 is readily replaced by removing the bottom leg and the wear resistant liner 30.

As will be understood by those skilled in the art, sacrificial wash ring 26, the wear resistant liner 30 and/or the bottom leg 48 can be replaced by field hands using new or refurbished replacement parts. Consequently, the frac head 10 is less expensive to maintain.

Figure 3:
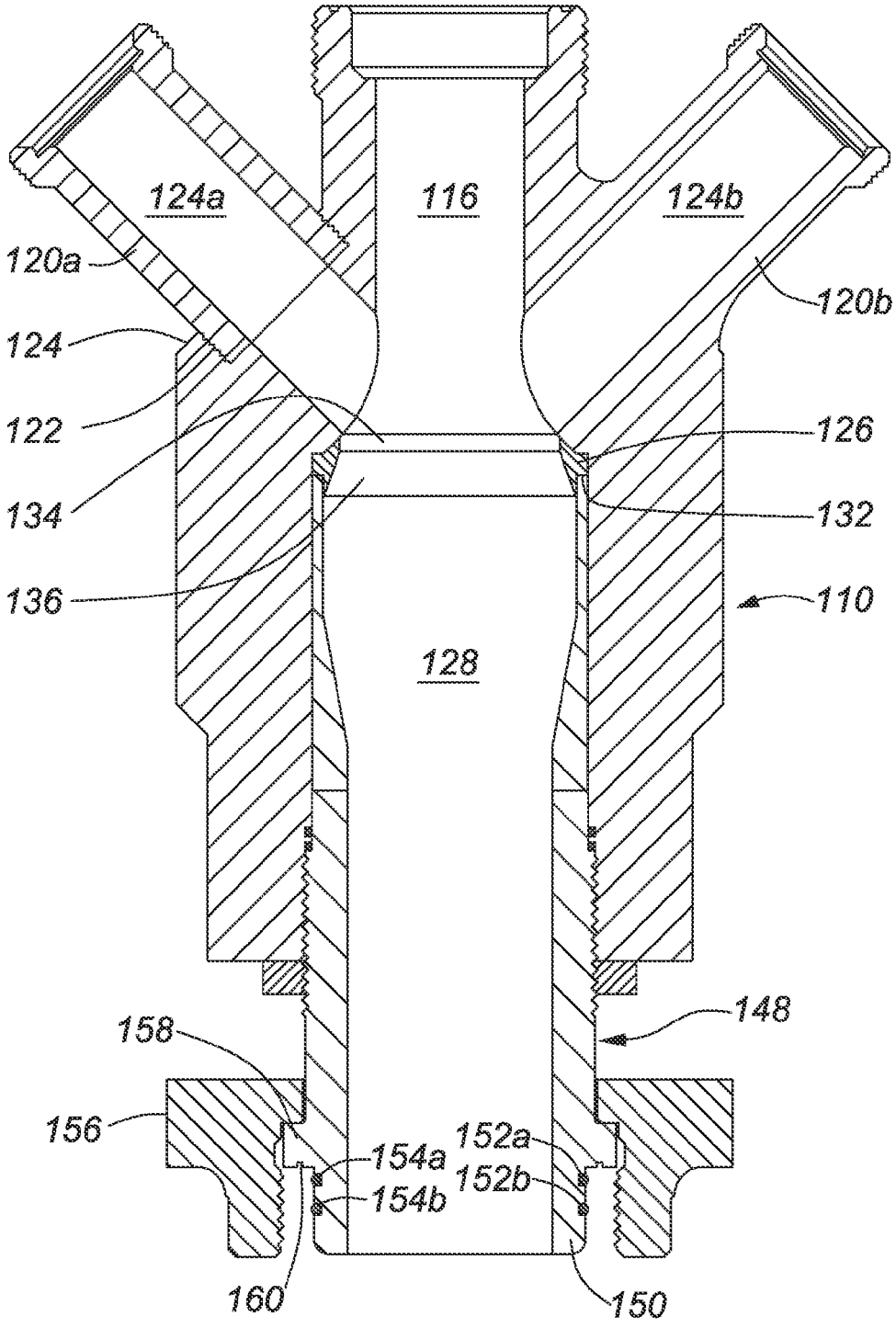
FIG. 3 is a schematic cross-sectional diagram of another embodiment of the frac head in accordance with the invention.

FIG. 3 is a schematic cross-sectional diagram of another embodiment of the frac head in accordance with the invention. The frac head 110 is similar to the frac head 10 described above with respect to FIG. 1 except for inlet ports 120*a*, 120*b*; sacrificial wash ring 126; and, removable bottom leg 148. The inlet ports 120*a* are threaded into sockets 122 formed in an annular shoulder 126 described in Assignee's U.S. Pat. No. 7,789,133, the specification of which is incorporated herein by reference. Alternatively, the frac head 110 may have traditional welded inlet ports 120*b*. It should be noted that generally all of the inlet ports of a frac head are of the same type.

The sacrificial wash ring 126 has a downwardly inclined top surface 134 and a downwardly and outwardly inclined bottom surface 136. The top surface 134 is substantially parallel with a central axis of the frac head 110. The bottom surface 136 is downwardly and outwardly inclined at an angle of about 45° with respect to the central axis of the frac head 110. However, it should be noted that the number of faces and the actual angle of inclination of the respective faces of the sacrificial wash ring is a matter of design choice. The function of the sacrificial wash ring is to control turbulence and protect the frac head body 110 from erosion. The sacrificial wash ring 126 may be configured in any way that will achieve that function. The top surface of the sacrificial wash ring 126 forces the respective frac fluid streams to converge as they flow from an axial passage 116 to a mixing chamber 128. The bottom surface 136 permits the converging frac fluid streams to rapidly expand as they enter the mixing chamber 128. The sacrificial wash ring 126 is slowly eroded in a way that is very similar to that described above with reference to FIG. 2.

The removable bottom leg 148 of the frac head 110 terminates in a threaded union described in the Assignee's U.S. Pat. No. 7,484,776, the specification of which is incorporated herein by reference. The threaded union connector includes a pin end 150 with two O-rings 152*a*, 152*b* received in O-ring grooves 154*a*, 154*b*. A wing nut 156 is supported by an annular shoulder 158 on a lower periphery of the bottom leg 148. A bottom surface of the annular shoulder 158 includes a metal ring gasket groove that accepts a metal ring gasket also described in Assignee's U.S. Pat. No. 7,484,776.

While two embodiments of the frac head in accordance with the invention have been described, it should be understood that the embodiments described above are exemplary only. For example, modifications to the shape of the sacrificial wash ring may be made. As well, the frac heads 10, 110 may be constructed with any one of a flanged bottom leg, a bottom leg with a threaded union, or an integral bottom leg with either of a flange or a threaded union. Other changes within the skill of an ordinary person in the art may also become apparent.

The scope of the invention is therefore intended to be limited solely by the scope of the appended claims.

I claim:

1. A frac head, comprising:

a frac head body having a top end with an axial port and an axial passage that extends though the axial port and the frac head body;

at least two inlet ports that respectively provide a fluid communication path to the axial passage where fluid streams pumped through the respective inlet ports converge;

a sacrificial wash ring in the axial passage adjacent a bottom edge of the respective fluid communication paths, the sacrificial wash ring directing fluid streams pumped through the respective inlet ports into a mixing chamber located below the sacrificial wash ring, the sacrificial wash ring having a bottom edge with an annular step on an outer side thereof; and a wear resistant liner that lines the mixing chamber, a top end of the wear resistant liner being received in the annular step to support the sacrificial wash ring in the axial passage.

2. The frac head as claimed in claim 1 wherein the sacrificial wash ring comprises a top surface that is downwardly and inwardly inclined, a cylindrical central surface and a bottom surface that is downwardly and outwardly inclined.

3. The frac head as claimed in claim 2 wherein the top surface is downwardly and inwardly inclined at a similar angle to an angle of inclination of the respective fluid communication paths.

4. The frac head as claimed in claim 2 wherein the bottom surface is downwardly and outwardly inclined at an angle of about 45° with respect to a central axis of the frac head.

5. The frac head as claimed in claim 1 wherein the sacrificial wash ring comprises a downwardly inclined top surface and a downwardly and outwardly inclined bottom surface.

6. The frac head as claimed in claim 5 wherein, the downwardly inclined top surface is parallel with a central axis of the frac head, and the downwardly and outwardly inclined bottom surface is downwardly and outwardly inclined at an angle of about 45° with respect to the central axis of the frac head.

7. The frac head as claimed in claim 1 wherein the frac head body comprises a bottom leg socket aligned with the axial passage, the bottom leg socket comprising a box thread and a seal bore.

8. The frac head as claimed in claim 7 further comprising a removable bottom leg threadedly secured in the bottom leg socket.

9. The frac head as claimed in claim 8 wherein the removable bottom leg terminates in a flange.

10. The frac head as claimed in claim 8 wherein the removable bottom leg terminates in a threaded union.

11. The frac head as claimed in claim 8 wherein the bottom leg comprises a first pin thread that cooperates with a box thread in the bottom leg socket to secure the removable bottom leg in the bottom leg socket.

12. The frac head as claimed in claim 11 wherein the removable bottom leg further comprises a second pin thread located below the first pin thread, and the second pin thread cooperates with a box thread of a lock nut that is tightened against a bottom end of the frac head body to lock the bottom leg in the bottom leg socket.

13. The frac head as claimed in claim 1 further comprising a removable wear resistant liner below the sacrificial wash ring, the removable wear resistant liner lining the mixing chamber.

14. The frac head as claimed in claim 13 wherein an upper end of the wear resistant liner supports the sacrificial wash ring.

15. The frac head as claimed in claim 13 wherein the wear resistant liner comprises a cylindrical outer sidewall, an inner sidewall that has a cylindrical upper section, a downwardly and inwardly inclined central section, and a cylindrical lower section.

16. The frac head as claimed in claim 13 wherein the wear resistant liner is supported by a top end of a removable bottom leg.

17. A frac head, comprising:

a frac head body having a top end with an axial port and a axial passage that extends though the axial port and the frac head body;

at least two inlet ports that respectively provide a fluid communication path to the axial passage;

a sacrificial wash ring in the axial passage at a bottom edge of the respective inlet ports, the sacrificial wash ring having a top surface that is inclined at an angle that is similar to an angle of inclination of the respective inlet ports so that frac fluid flows past a bottom edge of each fluid communication path; a cylindrical central surface that forces respective frac fluid streams to converge as they enter a mixing chamber below the sacrificial wash ring; and, a bottom surface that is downwardly and outwardly inclined to permit the converging frac fluid streams to rapidly expand as they enter the mixing chamber, the sacrificial wash ring further having a bottom edge with an annular step on an outer side thereof; and a wear resistant liner that lines the mixing chamber, a top end of the wear resistant liner being received in the annular step to support the sacrificial wash ring in the axial passage.

18. The frac head as claimed in claim 17 further comprising a removable bottom leg that terminates in a flange.

19. A frac head, comprising:

a frac head body having a top end with an axial port and an axial passage that extends though the axial port and the frac head body;

at least two inlet ports that respectively provide a fluid communication path to the axial passage;

a sacrificial wash ring in the axial passage at a bottom edge of the respective inlet ports, the sacrificial wash ring having a top surface and a bottom surface, the top surface being substantially parallel with a central axis of the frac head, and the bottom surface being inclined at an angle of about 45° with respect to the central axis of the frac head, the sacrificial wash ring further comprising a bottom edge with an annular step on an outer side thereof; and a wear resistant liner that lines the mixing chamber, a top end of the wear resistant liner being received in the annular step to support the sacrificial wash ring in the axial passage.

20. The frac head as claimed in claim 19 further comprising a removable bottom leg that terminates in a threaded union.

* * * * *